US011069961B2

(12) United States Patent
Sampo et al.

(10) Patent No.: US 11,069,961 B2
(45) Date of Patent: Jul. 20, 2021

(54) ANTENNA DEVICE HAVING AN ANTENNA ELEMENT COUPLED AT A NOTCH OF A GROUND CONDUCTOR THEREOF

(71) Applicant: YOKOWO CO., LTD., Tomioka (JP)

(72) Inventors: Takeshi Sampo, Tomioka (JP); Kenichi Yamada, Tomioka (JP); Yuki Kikuchi, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 16/349,434

(22) PCT Filed: Dec. 14, 2017

(86) PCT No.: PCT/JP2017/044978
§ 371 (c)(1),
(2) Date: May 13, 2019

(87) PCT Pub. No.: WO2018/110671
PCT Pub. Date: Jun. 21, 2018

(65) Prior Publication Data

US 2019/0273311 A1 Sep. 5, 2019

(30) Foreign Application Priority Data

Dec. 16, 2016 (JP) ..... JP2016-244784

(51) Int. Cl.
*H01Q 1/32* (2006.01)
*H01Q 5/30* (2015.01)
(Continued)

(52) U.S. Cl.
CPC ..... *H01Q 1/32* (2013.01); *H01Q 1/22* (2013.01); *H01Q 1/241* (2013.01); *H01Q 1/48* (2013.01);
(Continued)

(58) Field of Classification Search
CPC ..... H01Q 1/32; H01Q 1/3291; H01Q 1/325; H01Q 1/22; H01Q 1/2208; H01Q 1/2241;
(Continued)

(56) References Cited

U.S. PATENT DOCUMENTS 6,661,380 B1 * 12/2003 Bancroft ..... H01Q 1/243 343/700 MS
6,664,926 B1 * 12/2003 Zinanti ..... H01Q 1/38 343/700 MS
(Continued)

FOREIGN PATENT DOCUMENTS

JP 2005175935 A 6/2005
JP 2006352830 A 12/2006
(Continued)

OTHER PUBLICATIONS

Extended European Search Report for corresponding EP Application No. 17881410.9, 10 pages, dated May 8, 2020.
(Continued)

*Primary Examiner* — Jason Crawford
(74) *Attorney, Agent, or Firm* — Matthew B. Dernier, Esq.

(57) ABSTRACT

An antenna device to be mounted on a vehicle, including a ground conductor having a planar shape; and an antenna element which is a resonant type, is provided at a position so as not to overlap with the ground conductor within a plane substantially parallel to the ground conductor, and is configured to transmit or receive a polarized wave parallel to the ground conductor. A rectangular notch is formed in the ground conductor to have both a right and left edge portions with a predetermined width being left, and the antenna element is provided at a position overlapping with the notch in a plane substantially parallel to the ground conductor.

14 Claims, 12 Drawing Sheets

(51) Int. Cl.

| | |
|---|---|
| ***H01Q 9/04*** | (2006.01) |
| ***H01Q 1/24*** | (2006.01) |
| ***H01Q 1/48*** | (2006.01) |
| ***H01Q 9/42*** | (2006.01) |
| ***H01Q 21/29*** | (2006.01) |
| ***H01Q 13/08*** | (2006.01) |
| ***H01Q 1/22*** | (2006.01) |
| ***H01Q 21/28*** | (2006.01) |
| ***H01Q 5/371*** | (2015.01) |

(52) U.S. Cl.
CPC ..... *H01Q 5/30* (2015.01); *H01Q 5/371* (2015.01); *H01Q 9/045* (2013.01); *H01Q 9/42* (2013.01); *H01Q 13/08* (2013.01); *H01Q 21/28* (2013.01); *H01Q 21/29* (2013.01)

(58) Field of Classification Search
CPC ..... H01Q 1/241; H01Q 1/27; H01Q 1/48; H01Q 5/30; H01Q 9/04; H01Q 9/045; H01Q 9/42
USPC ..... 343/711, 713
See application file for complete search history.

(56) References Cited

U.S. PATENT DOCUMENTS

| | | | | |
|---|---|---|---|---|
| 6,707,427 | B2 * | 3/2004 | Konishi | H01Q 1/243 343/700 MS |
| 7,042,414 | B1 * | 5/2006 | Lee | H01Q 1/243 343/795 |
| 7,675,472 | B2 | 3/2010 | Mikami | |
| 7,777,677 | B2 | 8/2010 | Bungo | |
| 9,059,499 | B2 | 6/2015 | Hotta | |
| 9,184,500 | B2 * | 11/2015 | Wong | H01Q 9/0421 |
| 2004/0100407 | A1 * | 5/2004 | Okado | H01Q 9/285 343/700 MS |
| 2004/0155832 | A1 * | 8/2004 | Yuanzhu | H01Q 9/42 343/895 |
| 2005/0248487 | A1 * | 11/2005 | Okado | H01Q 1/38 343/700 MS |
| 2006/0262018 | A1 * | 11/2006 | Mikami | H01Q 9/0407 343/713 |
| 2010/0066621 | A1 * | 3/2010 | Chang | H01Q 5/28 343/767 |
| 2010/0220023 | A1 * | 9/2010 | Ge | H01Q 1/22 343/772 |
| 2012/0249390 | A1 | 10/2012 | Shirakawa | |
| 2013/0285870 | A1 | 10/2013 | Hotta | |
| 2014/0320367 | A1 * | 10/2014 | Alkhateeb | H01Q 1/38 343/804 |
| 2015/0116153 | A1 * | 4/2015 | Chen | H01Q 9/04 342/359 |
| 2015/0130679 | A1 * | 5/2015 | Shin | H01Q 1/27 343/848 |
| 2015/0155627 | A1 | 6/2015 | Wong | |
| 2015/0188230 | A1 * | 7/2015 | Kim | H04B 1/40 455/90.2 |
| 2015/0236420 | A1 * | 8/2015 | Iino | H01Q 9/0407 343/894 |
| 2015/0288067 | A1 * | 10/2015 | Kwon | H01Q 21/30 320/108 |
| 2016/0322702 | A1 * | 11/2016 | Sayama | H01Q 3/28 |
| 2017/0324138 | A1 * | 11/2017 | Talty | H01Q 5/371 |
| 2017/0324139 | A1 * | 11/2017 | Talty | H01Q 13/20 |
| 2017/0324142 | A1 | 11/2017 | Talty | |
| 2018/0115080 | A1 * | 4/2018 | Hussain | H01Q 21/00 |

FOREIGN PATENT DOCUMENTS

| | | | |
|---|---|---|---|
| JP | 4329579 | B2 | 9/2009 |
| JP | 2010081500 | A | 4/2010 |
| JP | 2012205231 | A | 10/2012 |
| JP | 2013229823 | A | 11/2013 |

OTHER PUBLICATIONS

International Search Report for corresponding PCT Application No. PCT/JP2017/044978, 3 pages, dated Mar. 6, 2018.

* cited by examiner

ANTENNA DEVICE HAVING AN ANTENNA ELEMENT COUPLED AT A NOTCH OF A GROUND CONDUCTOR THEREOF

TECHNICAL FIELD

The present invention relates to an antenna device suitable for radiating an electromagnetic wave of a horizontally polarized wave (receiving an electromagnetic wave of a horizontally polarized wave) in a horizontal plane, which is horizontal to the ground.

BACKGROUND ART

In an antenna device for satellites, for example, Global Navigation Satellite System (GNSS), which is arranged in an instrument panel of an automobile (in particular, at a position close to a windshield) in a related art, there has generally been used a patch antenna, and a metal plate being a ground plate is normally required. Further, a TEL (telephone) antenna is required to be mounted together with the GNSS satellite antenna. In the related art, a vertically polarized wave has been required.

However, in Long Term Evolution (LTE) using Multiple-Input Multiple-output (MIMO) technology, a horizontally polarized wave may be required to be generated in a horizontal plane. On this occasion, when an element is formed on the ground plate, there has been a problem in that the horizontally polarized wave is hardly generated in the plane parallel to the ground plate.

This problem is explained below. FIG. 22 shows a basic structural example of a GNSS patch antenna arranged in an instrument panel of an automobile to receive GNSS signals. A patch antenna 10 includes a radiation electrode 13 formed on a main surface of a dielectric body 12 and a ground plate 20 as a ground conductor provided on an opposite side of the main surface. A low noise amplifier (LNA) substrate 15 configured to amplify a received signal is arranged between the dielectric body 12 and the ground plate 20. A surface opposite to the main surface of the dielectric body 12 is a ground (GND) electrode to be electrically connected to the ground plate 20. The ground plate 20 is required to, due to antenna characteristics, have an area considerably larger than an area of a floor of the dielectric body 12. In the GNSS patch antenna, the ground plate 20 is arranged horizontally, and the radiation electrode 13 is arranged upward, that is, is set at an elevation angle of 90 degrees.

FIG. 23 shows a conventional composite antenna device including a TEL antenna element 16 serving as a telephone transmission and/or reception antenna in addition to the GNSS patch antenna of FIG. 22. The same members as those of FIG. 22 are denoted by the same symbols.

The TEL antenna element 16 of FIG. 23 stands in a vertical direction on the LNA substrate 15 with respect to the ground plate 20 and then extends parallel to the ground plate 20. In this case, a portion vertically extending in the vertical direction to the ground plate 20 of the TEL antenna element 16 mainly generates an electromagnetic wave, and a polarized wave is generated in a perpendicular direction with respect to the ground plate 20. The portion of the TEL antenna element 16 extending parallel to the ground plate 20 in a horizontal direction is closed to the ground plate 20. For that reason, a current in an opposite phase is generated in the ground plate 20, and an electromagnetic wave to be a polarized wave (horizontally polarized wave) parallel to the ground plate 20 is not generated. Substantially the same structure of FIG. 23 is disclosed in Patent Literature 1 below.

However, a vertically polarized wave of an electromagnetic wave generated by the telephone antenna becomes strong for the same reason.

FIG. 24 is a view for illustrating an example including a flat-plate-like TEL antenna element 17 as a TEL transmission and/or reception antenna on the ground plate 20 in addition to the GNSS patch antenna of FIG. 22, and the same members as those of FIG. 22 are denoted by the same symbols. As described in FIG. 23, the TEL antenna element 17 is provided to be adjacent parallel to the ground plate 20, and hence an electromagnetic wave of a polarized wave (horizontally polarized wave) parallel to the ground plate 20 is not generated for the same reason.

PRIOR ART DOCUMENTS

Patent Literature

[PTL 1] JP 2010-81500 A

SUMMARY OF INVENTION

Problems to be Solved by the Invention

The present invention has been made in view of the above described circumstances, and has an object thereof to provide an antenna device capable of transmitting and/or receiving an electromagnetic wave of a horizontally polarized wave when an antenna element is horizontally arranged in the antenna device including a ground conductor.

Solution to the Problems

According to an aspect of the present invention, an antenna device is provided. The antenna device is to be mounted on a vehicle, which includes: a ground conductor having a planar shape; and an antenna element which is a resonant type, is provided at a position so as not to overlap with the ground conductor within a plane substantially parallel to the ground conductor, and is configured to transmit or receive a polarized wave parallel to the ground conductor. The expression "an antenna element which is a resonant type" refers to an antenna element capable of transmitting or receiving an electric wave by resonance.

In the antenna device, a part of the ground conductor includes a cut-out portion, and the antenna element may be provided to the cut-out portion. Alternatively, the antenna device may further include: a substrate fixed on a surface of the ground conductor, wherein a part of a surface and a rear surface of the substrate are non-conductive surfaces exposed from the cut-out portion, and wherein the antenna element is a conductive pattern formed on the non-conductive surface.

In another aspect of the present invention, the part of the surface of the substrate is a conductive surface which is conductive to the ground conductor, wherein the substrate has a feeding conductive pattern which is not conductive to the conductive surface, and wherein a feeding end of the antenna element is conductive to the feeding conductive pattern.

In still another aspect of the present invention, wherein the antenna element has a plurality of end portions. In this case, one of the plurality of the end portions is conductive to the conductive surface, and another one of the plurality of the end portions is the feeding end. Alternatively, one of the plurality of the end portions is conductive to the feeding conductive pattern, and another one of the plurality of the end portion is an open end.

In yet another aspect of the present invention, the antenna element may be configured to have at least a portion having a meander shape. In this case, the antenna element includes a high-band portion for LTE high-band operation and a low-band portion for LTE low-band operation, the high band portion may have a plate shape, and the low-band portion may have a meander shape which extends from the high-band portion.

In still yet another aspect of the present invention, the antenna element includes a high-band portion for LTE high-band operation and a low-band portion for LTE low-band operation. However, the high band portion has a plate shape, the low-band portion has at least a portion having a meander shape, and the high-band portion and the low-band portion are configured to share a feeding end. Alternatively, each of the high-band portion and the low-band portion has at least a portion having a meander shape, and is configured to share a feeding end.

In those cases, there may be configured such that distal end portions of the low-band portion and the high-band portion are arranged substantially parallel to each other from the feeding end, and the distal end portion of the low-band portion is arranged farther from a surface portion, which is conductive to the ground conductor, than the distal end portion of the high-band portion.

It is preferred that an element having a meander shape of the low-band portion be configured to start turning from a closest portion with respect to the high-band portion.

In still yet another aspect of the present invention, there may be provided an antenna device, wherein a patch antenna is provided at any portion of the conductive surface via a dielectric body.

In still yet another aspect of the present invention, the antenna device further includes: a holder, which is configured to accommodate a body portion of the antenna device including the substrate and the ground conductor, and is removably mountable from/to an antenna attachment mechanism provided in the vehicle. The holder includes a bottom surface portion which faces the ground conductor, and a lateral width and a length in a longitudinal direction of the ground conductor are approximately equal to a lateral width and a length in the longitudinal direction of the bottom surface portion of the holder.

Any combinations of the structure components above, and conversions of expressions of the present invention between methods and systems are also valid as aspects of the present invention.

Advantageous Effects of the Invention

According to the antenna device of the present invention, the antenna device includes the ground conductor, and the antenna element extending at a position so as not to overlap with the ground conductor in the plane substantially parallel to the ground conductor, thereby being capable of transmitting and/or receiving the electromagnetic wave of a horizontally polarized when the antenna element is horizontally arranged.

DESCRIPTION OF EMBODIMENTS

Hereinafter, preferred embodiments of the present invention are described in detail with reference to the drawings. The same or equivalent structural elements, members, processes, and the like, illustrated in each drawing are denoted by the same symbols, and duplicate description thereof is omitted as appropriate. Further, the embodiments do not limit the invention and are illustrative. All of the features and combinations described in the embodiments are not necessarily essential to the present invention.

First Embodiment

Figure 1A:
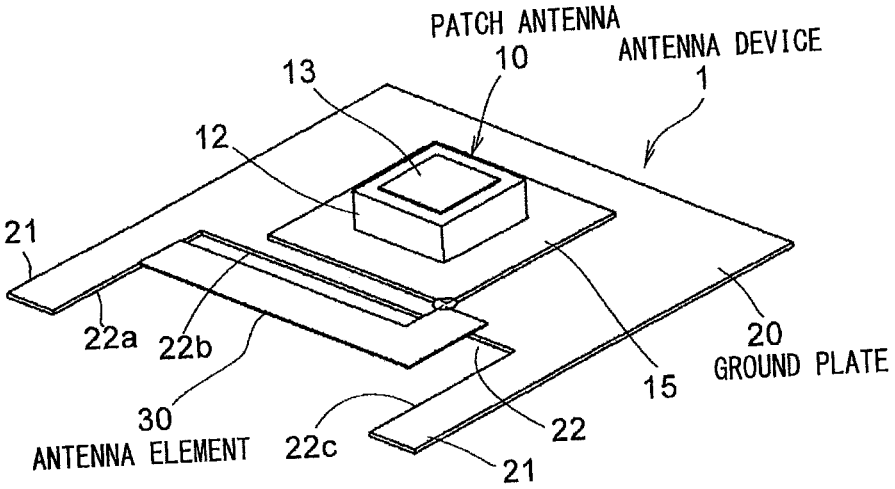
FIG. 1A is a perspective view for illustrating an antenna device according to a first embodiment of the present invention.
Figure 1B:
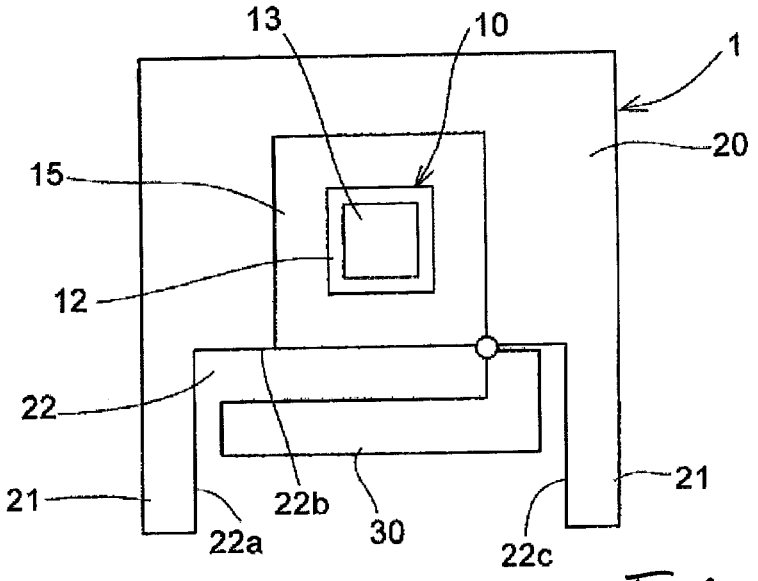
FIG. 1B is a plan view of FIG. 1A.

FIG. 1A and FIG. 1B illustrate an antenna device according to a first embodiment of the present invention. In these drawings, an antenna device 1 includes a GNSS patch antenna 10 arranged in an instrument panel of an automobile as a vehicle to receive GNSS signals, a ground plate 20 serving as a ground conductor, and a TEL antenna element 30 as an example of an antenna element of a resonant type. In the following description, the GNSS patch antenna is referred to as "patch antenna", and the TEL antenna element is referred to as "antenna element". Further, a portion including the patch antenna 10, the ground plate 20, and the antenna element 30 may be referred to as "body portion of the antenna device" or "main portion".

A portion (a portion of an end surface in this example) of the ground plate 20 is cut out toward an inner side thereof. Hereinbelow, for the sake of convenience, the cut-out portion is referred to as "notch". In the illustrated example, a notch 22 is formed to have both a right and left edge portions 21 with a predetermined width of an end surface of one side of the ground plate 20. The antenna element 30 is, for example, a flat plate element having an L-shape, and is provided at a position not overlapping with the ground plate 20 in a plane substantially parallel to an LNA substrate 15 and the ground plate 20, in other words, at the position in the notch 22. At this time, a power feeding side (feeding end) of the antenna element 30 may be partially overlapped with the ground plate 20, but the main portion of the antenna element 30 is configured not to overlap with the ground plate 20.

Figure 22:
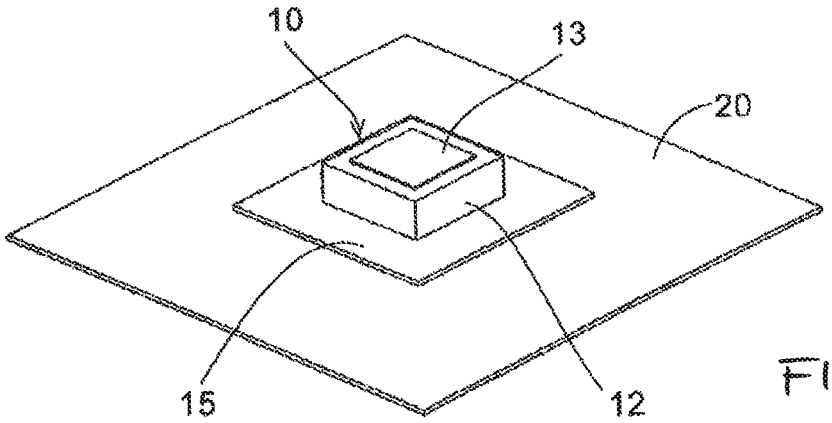
FIG. 22 (Prior Art)
FIG. 22 is a perspective view for illustrating a basic structure example of a GNSS patch antenna, when viewed from above.
Figure 23:
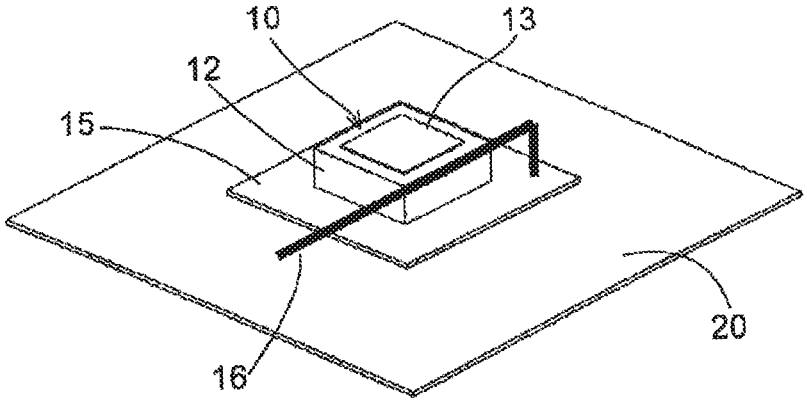
FIG. 23 (Prior Art)
FIG. 23 is a perspective view of a conventional composite antenna device including a TEL antenna element in addition to the GNSS patch antenna of FIG. 22, when viewed from above.

One end serving as the feeding end (end portion on a short side in the L-shape) of the antenna element 30 is connected to a feeding conductive pattern (not shown in the drawings) of the LNA substrate 15. Another end (end portion on a long side in the L-shape) of the antenna element 30 is an open end. Further, the antenna element 30 is arranged so as not to protrude from the notch 22. The structure of the patch antenna 10 is similar to that of FIG. 22, and description thereof is omitted.

In the structure of the first embodiment, the notch 22 is formed at a portion overlapping with the antenna element 30. For that reason, an influence by a current in a reversed phase, which is generated in the ground plate 20 when the power is supplied to the antenna element 30, can be eliminated, and hence variation in electric field is generated in a plane parallel to the antenna element 30 and the ground plate 20, and a horizontally polarized wave is generated when the antenna element 30 is arranged horizontally to the ground. Further, a high frequency current is easily formed as a standing wave across a whole length of inner peripheral edge portions 22*a*, 22*b*, and 22*c* of three sides of the notch 22. As compared to a case in which both of the right and left edge portions 21 are not left by being cut out straight, satisfactory antenna transmission and reception characteristics can be obtained in a desired frequency band.

Figure 2:
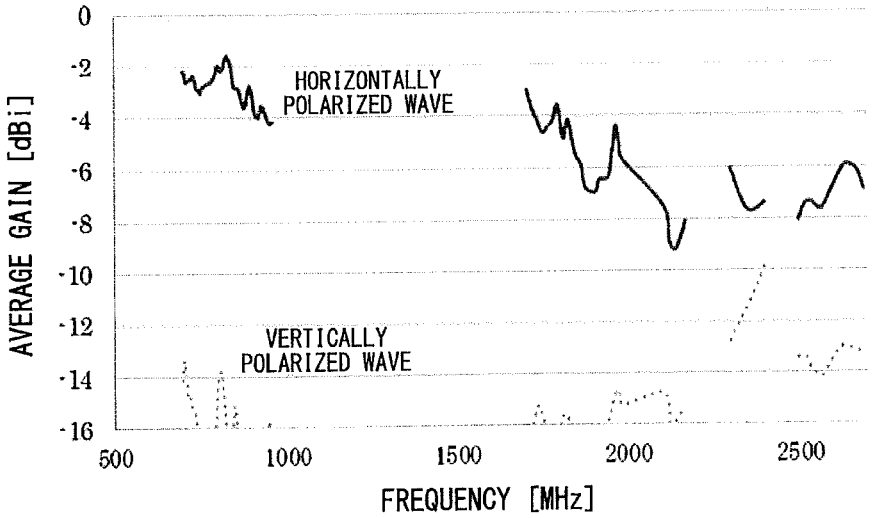
FIG. 2 is a graph showing frequency characteristics of gain in horizontally polarized waves in comparison with a case in vertically polarized waves in the antenna device of the first embodiment.

FIG. 2 is a graph showing a result example of a measurement for gain in the horizontal plane of the antenna device 1, and frequency characteristics of average gain (dBi) in the horizontally polarized waves are shown in comparison with a case of vertically polarized waves. It can be seen that, from FIG. 2, the average gain in the vertically polarized waves is very small, but the average gain in the horizontally polarized waves is sufficiently large.

According to this embodiment, the following effects can be obtained.

(1) The antenna element 30 is provided at the position so as not to overlap with the ground plate 20 in the plane substantially parallel to the ground plate 20, that is, at the position in the notch 22 formed on the ground plate 20. For that reason, an influence by a current in a reversed phase, which is generated in the ground plate 20 when the power is supplied to the antenna element 30, can be eliminated. As a result, an electromagnetic wave of a polarized wave parallel to the antenna element 30 (that is, an electromagnetic wave of a horizontally polarized wave when the antenna element 30 is arranged horizontally to the ground) can be radiated in a direction parallel to a plane in which the antenna element 30 is arranged (that is, a horizontal direction), and an electromagnetic wave of horizontally polarized wave can be transmitted and received satisfactorily.

(2) The notch 22 having the right and left edge portions 21 with a predetermined width is formed in the ground plate 20, and the total length of the inner peripheral edge portions 22*a*, 22*b*, and 22*c* of the notch 22 is longer than that in a case in which the notch is formed linearly without leaving both the right and edge portions 21. Therefore, a high-frequency current is easily formed as a standing wave over lower frequency bands, and satisfactory antenna transmission and reception characteristics can be obtained in a desired frequency bands (that is, from 699 MHz to 960 MHz, and from 1710 MHz to 2690 MHz).

(3) Through formation of the notch 22 having both the right and left edge portions 21 of the ground plate 20 with a predetermined width, an influence by a reduction in an area of the ground plate 20 due to the formation of the notch 22 can be suppressed. Further, even when the patch antenna 10 is mounted on the ground plate 20, a required ground plate area can be secured and deterioration in characteristics of the patch antenna 10 can be avoided.

(4) The antenna element 30 is arranged so as not to protrude from the notch 22, and hence a mounting area for the antenna device 1 is not increased due to mounting the antenna element 30.

Second Embodiment

Figure 3:
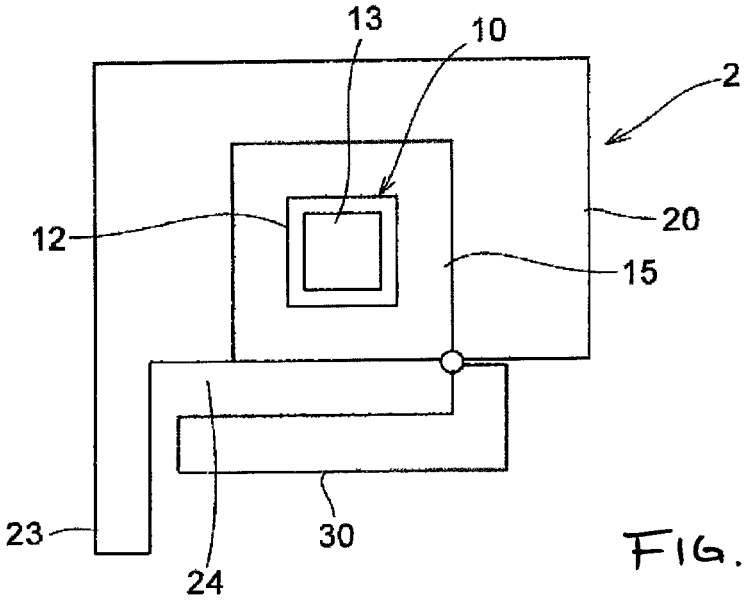
FIG. 3 is a plan view for illustrating a second embodiment of the present invention.

FIG. 3 shows a second embodiment of the antenna device according to the present invention. In this drawing, the antenna device 2 includes the patch antenna 10 and the antenna element 30, but the ground plate 20 has a different shape. That is, a notch 24 is formed to have one side edge portion 23 with a predetermined width in a part of an end surface of the ground plate 20. Other structures are similar to those of the first embodiment.

In this case, the antenna element 30 is at the position so as not to overlap with the ground plate 20 in the plane substantially parallel to the ground plate 20, that is, at the position in the notch 24 formed in the ground plate 20. For that reason, an influence by a current in a reversed phase, which is generated in the ground plate 20 when the power is supplied to the antenna element 30, can be eliminated, and when the antenna device 2 is arranged horizontally to the ground, an electromagnetic wave of a horizontally polarized wave can be transmitted and received satisfactorily.

Further, the total length of the inner peripheral edge portions of the notch 24 is longer than that in the case in which the notch is formed linearly without having the one side edge portion 23. For that reason, satisfactory antenna transmission and reception characteristics can be obtained in desired frequency bands. Still further, the antenna element 30 is configured not to protrude from the notch 24, and hence a mounting area for the antenna device 2 is not increased due to mounting the antenna element 30.

Third Embodiment

Figure 4:
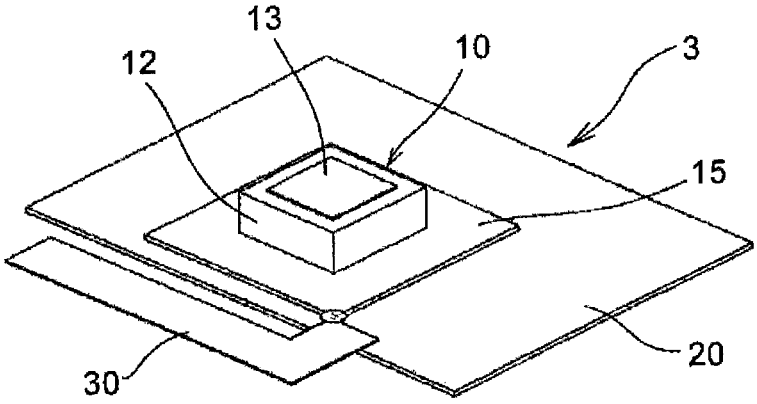
FIG. 4 is a perspective view for illustrating a third embodiment of the present invention.

FIG. 4 shows a third embodiment of the antenna device according to the present invention. In this drawing, an antenna device 3 includes the patch antenna 10 and the antenna element 30, but the ground plate 20 has a different shape. That is, as a result of one end surface of the ground plate 20 which was cut out linearly from one edge to another edge, it seems as if the notch 22 described above were not formed. Other structures are similar to those in the first embodiment.

In this case, the antenna element 30 is positioned at the position so as not to overlap with the ground plate 20 in the plane substantially parallel to the ground plate 20. For that reason, an influence by a current in a reversed phase, which is generated in the ground plate 20 when the power is supplied to the antenna element 30, can be eliminated, and when the antenna device 3 is arranged horizontally to the ground, an electromagnetic wave of a horizontally polarized wave can be transmitted and received satisfactorily.

Fourth Embodiment

Figure 5:
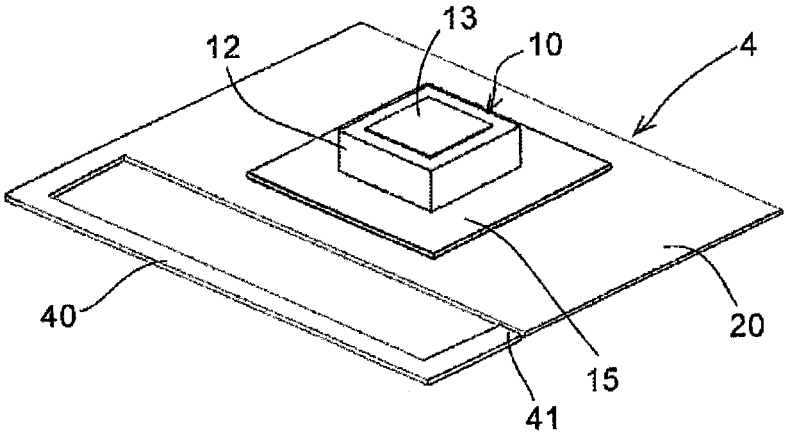
FIG. 5 is a perspective view for illustrating a fourth embodiment of the present invention.

FIG. 5 shows a fourth embodiment of the antenna device according to the present invention. In this drawing, an antenna device 4 includes the patch antenna 10 and an antenna element 40. The antenna element 40 is integrally formed with the ground plate 20. That is, the antenna element 40 has a plurality of end portions, one end of which is electrically connected to the ground plate 20 (conductive surface), and another end of the antenna element 40 is used as a feeding end 41. A shape, especially, an arrangement or the shape of the antenna element 40 illustrated in FIG. 5 is illustrative, and can be changed in accordance with a resonant length of a frequency to be used. Further, the antenna element 40 may be formed as a conductor plate of a separate component instead of being integrally formed with the ground plate 20, and one end thereof may be connected by soldering or the like. Other structures are similar to those of the first embodiment.

In this embodiment, the antenna element 40 is positioned at the position so as not to overlap with the ground plate 20 in the plane substantially parallel to the ground plate 20. For that reason, an influence by a current in a reversed phase, which is generated in the ground plate 20 when the power is supplied to the antenna element 30, can be eliminated, and when the antenna device 4 is arranged horizontally to the ground, an electromagnetic wave of a horizontally polarized wave can be transmitted and received satisfactorily.

Fifth Embodiment

A fifth embodiment of the antenna device according to the present invention is explained with reference to FIG. 6 to FIG. 10. As illustrated in these drawings, the antenna device 5 includes a substrate 50 on which the patch antenna 10 and the antenna element 30 (FIG. 9 and FIG. 10) are provided, the ground plate 20 as a ground conductor fixed to the substrate 50, and a holder 60 which accommodates the body portion of the antenna device including the substrate 50 and the ground plate 20, and which is detachable from and attachable to an antenna attachment mechanism (not shown in the drawings) provided in the vehicle. The substrate 50 is fixed to the ground plate 20 at a plurality of positions by screws 67. The holder 60 holds the right and left edge portions 21 of the ground plate 20.

Figure 9:
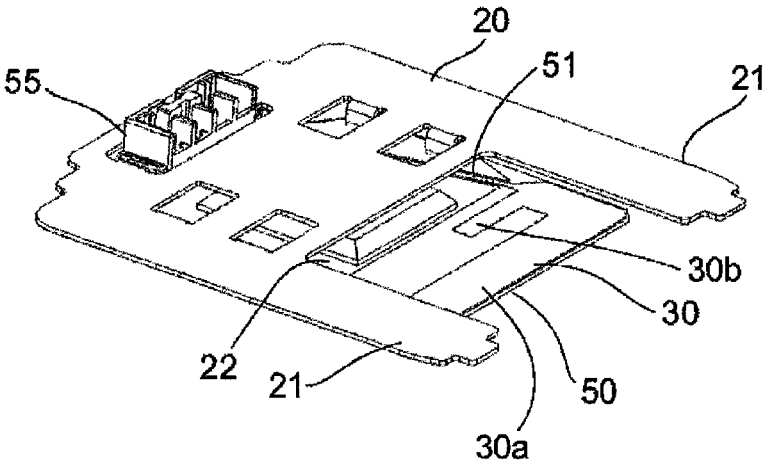
FIG. 9 is a perspective view of FIG. 8, when viewed from below.
Figure 10:
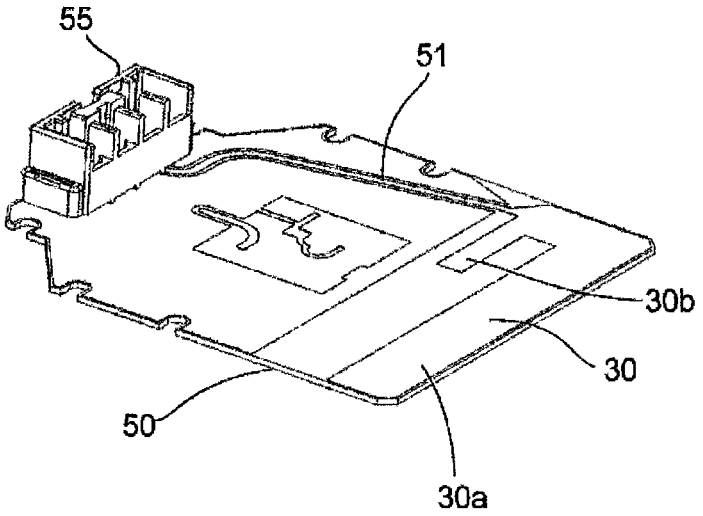
FIG. 10 is a perspective view for illustrating a substrate of the fifth embodiment, when viewed from below.

In this case, as illustrated in FIG. 9 and FIG. 10, the antenna element 30 is formed as a conductive pattern on a bottom surface of the substrate 50 (surface opposite to a mount surface for the dielectric body 12 of the patch antenna 10). The antenna element 30 is arranged at a position so as to overlap with the notch 22 which is formed in the ground plate 20 in a plane parallel to the substrate 50 and the ground plate 20. Though a GND conductive pattern 52 is formed as one example of a conductive surface so as to include a region, on which the dielectric body 12 is arranged, on an upper surface of the substrate 50, the antenna element 30 is formed on a rear side region of a square region 53 at an upper surface in which the GND conductive pattern 52 is not formed.

The antenna element 30 has, for example, an F-shape, and includes a long element portion 30*a* and a short element portion 30*b*. The long element portion 30*a* is arranged to be close to an edge (in the case illustrated, along the edge) facing an opening of the notch 22, and the short element portion 30*b* is arranged at an inner side of the long element portion 30*a*. One end serving as the feeding end of the antenna element 30 is conductive to a feeding conductive pattern 51 of the substrate 50 to be electrically connected to a terminal of a connector 55 fixed to the bottom surface of the substrate 50. Received signals by the patch antenna 10 are also transmitted to another terminal of the connector 55. As a result, the patch antenna 10 and the antenna element 30 are electrically connected to an in-vehicle electronic device via the connector 55. Other structures are similar to those of the first embodiment.

Figure 6:
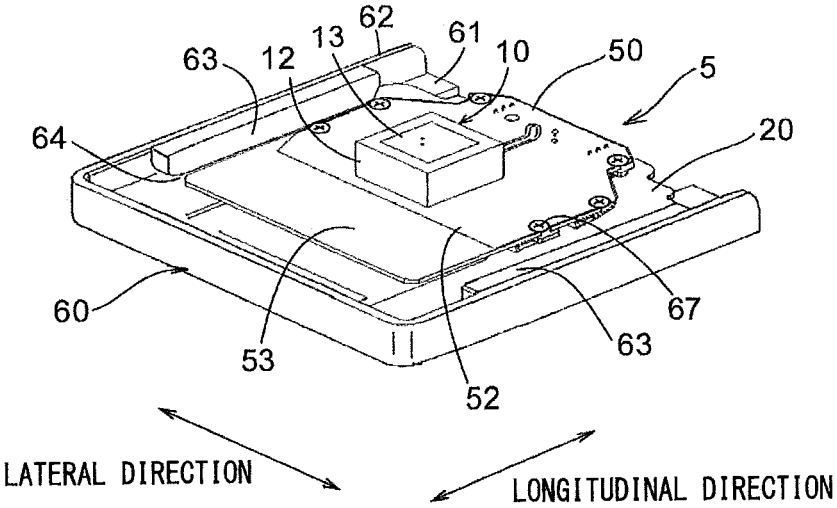
FIG. 6 is a perspective view when viewed from above for illustrating a structure of a fifth embodiment of the present invention in which an antenna element is provided on a substrate, which is fixed on a ground plate, to be held at both edges of the ground plate by a holder.
Figure 7:
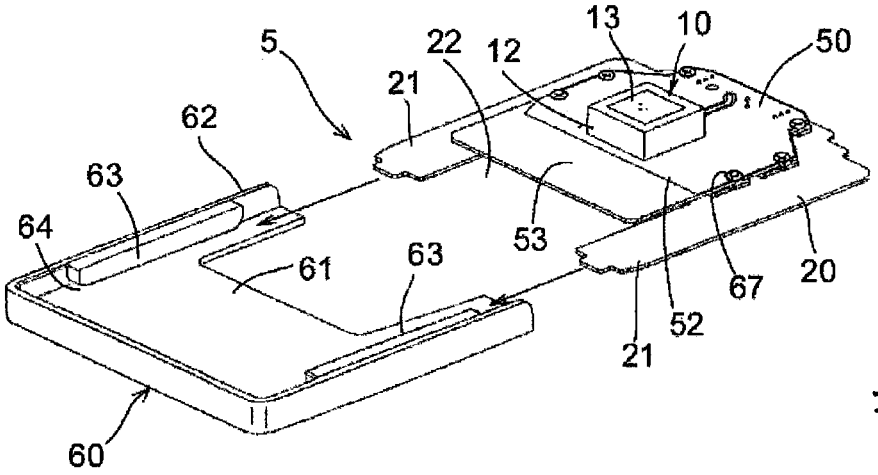
FIG. 7 is an exploded perspective view of FIG. 6.
Figure 8:
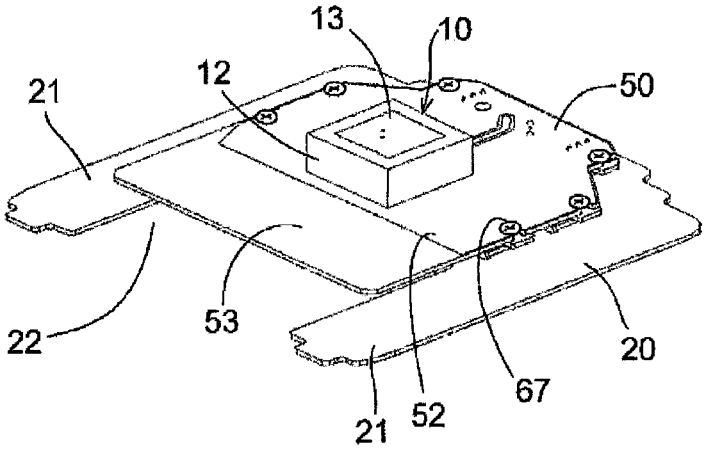
FIG. 8 is a perspective view for illustrating a main portion of the fifth embodiment without the holder when viewed from above.

As illustrated in FIG. 6 and FIG. 7, the holder 60 includes a bottom surface portion 61, and a frame-shaped portion 62 having a shape without one side of a square frame (U-shape) which extends from an edge of the bottom surface portion 61. Both the edge portions 21 of the ground plate 20 are inserted and held in grooves 64 between protruding portions 63 formed on right and left inner surfaces toward an opening of the frame-shaped portion 62 and the bottom surface portion 61. Here, in FIG. 6, when a width direction of the opening of the frame-shaped portion 62 is defined as a lateral direction, and a direction orthogonal to the lateral direction is defined as a longitudinal direction, lengths in the lateral direction and a length in the longitudinal direction of the ground plate 20 are set to a size approximately the same as a width in the lateral direction and a length in the longitudinal direction of the bottom surface portion 61 of the holder facing the ground plate 20. That is, the holder 60 is set to have a shape and a size capable of accommodating the body portion of the antenna device which includes the substrate 50 mounted with the patch antenna 10 and the antenna element 30 and which includes the ground plate 20 fixed to the substrate 50. The holder 60 is fixed in the instrument panel.

According to the structure of the fifth embodiment, in addition to the effects of the first embodiment described above, the following effects can be obtained.

(1) The antenna element 30 is formed as a conductive pattern on the substrate 50 mounted with the patch antenna 10, and hence the antenna device is excellent in mass production and is advantageous in cost.

(2) The notch 22 is formed to have both the right and left edge portions 21 of the ground plate 20, thereby both the right and left edge portions 21 can be used to be held by the holder 60, and a sufficient side surface length (length in the longitudinal direction) of the ground plate 20 can be secured to ensure the holding.

(3) When the antenna element 30 has an F-shape including the long element portion 30*a* and the short element portion 30*b*, the antenna device can resonate at two frequency bands, thereby widening a band can be achieved. Further, the long element portion 30*a* which resonates at a frequency band having a long wavelength is arranged to be close to the edge facing the opening of the notch 22 (in the case illustrated, along the edge), and hence an influence by proximity of the ground plate 20 can be further reduced.

(4) Though the substrate 50 is fixed to the ground plate 20 by the screws 67, at this time, the GND conductive pattern 52 on the substrate 50 side is electrically connected to the ground plate 20. In particular, when the GND conductive pattern 52 is electrically connected to the ground plate 20 by the screws 67 at a position close to a power supply point of the antenna element 30, an electrical connection path between the GND conductive pattern 52 and the ground plate 20 is avoided to be long to improve the antenna characteristics.

As described above, when the ground plate 20 is required to have a wide area, though the present invention is effective to generate an electromagnetic wave of a polarized wave parallel to the antenna elements 30 and 40 substantially parallel to the ground plate 20, it is understood by those skilled in the art that each structure element and each process of the first to the fifth embodiments can be modified variously within a range of claims. Various modification examples are described below.

In the first embodiment to the third embodiment, the examples are illustrated in which the antenna element 30 has an L-shape, but as long as a horizontally polarized wave can be generated, the shape is not limited to the L-shape but may be the F-shape or the like of the fifth embodiment.

The patch antenna 10 is not limited for the GNSS, and may be mounted for other satellites such as GPS (satellite broadcasting reception, etc.).

Sixth Embodiment

Figure 11:
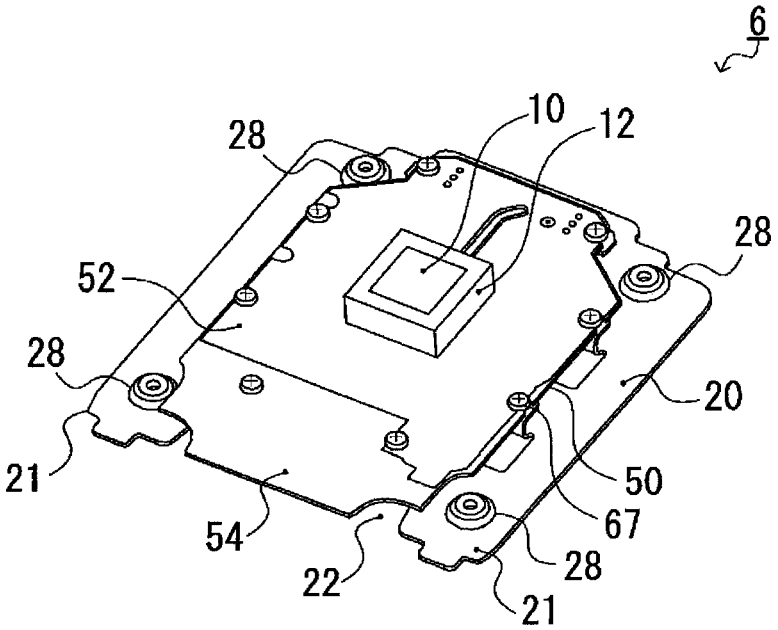
FIG. 11 is a perspective view for illustrating a body portion of the antenna device of a sixth embodiment of the present invention, when viewed from above.

A sixth embodiment of the antenna device according to the present invention is explained with reference to FIG. 11 to FIG. 13. FIG. 11 is an external perspective view of the body portion of the antenna device in this embodiment. An antenna device 6 of this embodiment is slightly different from that of the fifth embodiment in the shapes and the structures of the ground plate 20 and the substrate 50, and an antenna element 42. Other structures are the same as those of the fifth embodiment. That is, in the antenna device 6 of this embodiment, both the right and left edge portions 21 of the ground plate 20 are shorter than those of the fifth embodiment, therefore, an area of the notch 22 in a concave shape is smaller by that size. Mounting holes 28 to an antenna cover (not shown) are formed in both the right and left edge portions 21. The body portion of the antenna device fixed with the antenna cover is inserted in and held by the holder 60. The antenna device 6 having the body portion of the antenna device held by the holder 60 is fixed in the instrument panel.

Further, the substrate 50 fixed substantially parallel to the surface of the ground plate 20 has, for example, an integral shape in which a square and both ends thereof form an approximate trapezoid, and the GND conductive pattern 52 as a conductive surface is formed on a portion except the approximate trapezoidal region 54. The GND conductive pattern 52 is electrically connected to the ground plate 20. The patch antenna 10 is provided on a predetermined portion of the GND conductive pattern 52, for example, on a surface of a substantially central portion through intermediation of the dielectric body 12.

A length between both ends of the substrate 50 is substantially the same as a length of the ground plate 20 in the same direction. Further, a distal end portion of the approximate trapezoidal region 54 of the substrate 50 is on a line connecting distal end portions of the right and left end portions 21 of the ground plate 20.

The approximate trapezoidal region 54 as a part of the substrate 50 forms a non-conductive surface, which is exposed from the notch 22, having a radio wave transmission property, and the antenna element 42 is a conductive pattern formed on the non-conductive surface. Thus, the antenna element 42 is provided at a position so as not to overlap with the ground plate 20 in a plane substantially parallel to the ground plate 20, and transmits or receives a polarized wave parallel to the ground plate 20. The structure of such an antenna element 42 is illustrated in FIG. 12.

Figure 12:
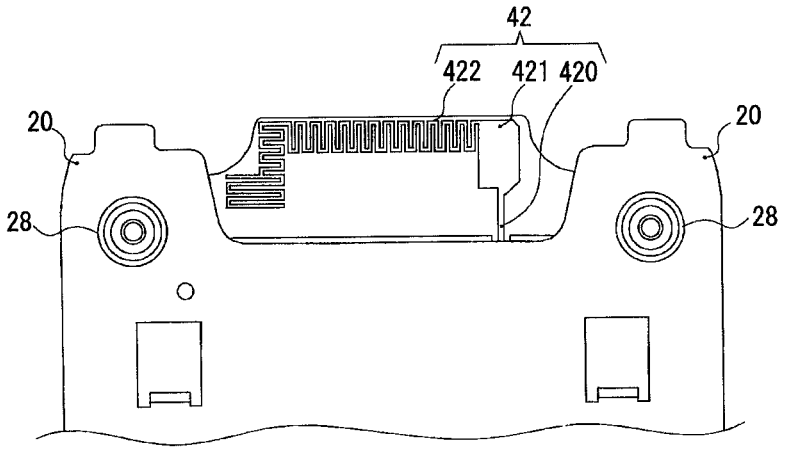
FIG. 12 is a plan view for illustrating the body portion of the antenna device, when viewed from below.

FIG. 12 is a plan view for illustrating the body portion of the antenna device of FIG. 11 when viewed from below (antenna mount mechanism of the vehicle). The antenna element 42 includes a high-band portion 421 as a plate-shaped conductive pattern and a low-band portion 422 as a meander-shaped conductive pattern.

A distal end of the low-band portion 422 is open-ended, and, a proximal end thereof extends from a portion farther away with respect to the feeding end 420 of the high-band portion 421. Further, the low-band portion 422 is formed such that an orientation of a portion at which the element is bent on a way along an outer periphery of the substrate 50 (hereinafter, "turn") and an element length are changed so as to be sized which allows signals in a low-band (699 MHz to 960 MHz) of LTE to be transmitted and received.

The high-band portion 421 is designed to have a size which allows signals in a high-band (1710 MHz to 2690 MHz) of LTE to be transmitted and received. The feeding conductive pattern 51 described above is electrically connected (conductive) to the feeding end 420 also serving as a proximal end of the high-band portion 421.

The high-band portion 421 resonates at a higher frequency band than the low-band portion 422 to be relatively less susceptible to an influence by the ground plate 20. For that reason, the high-band portion 421 is formed at a position closer to the ground plate 20 than the low-band portion 422.

Figure 13:
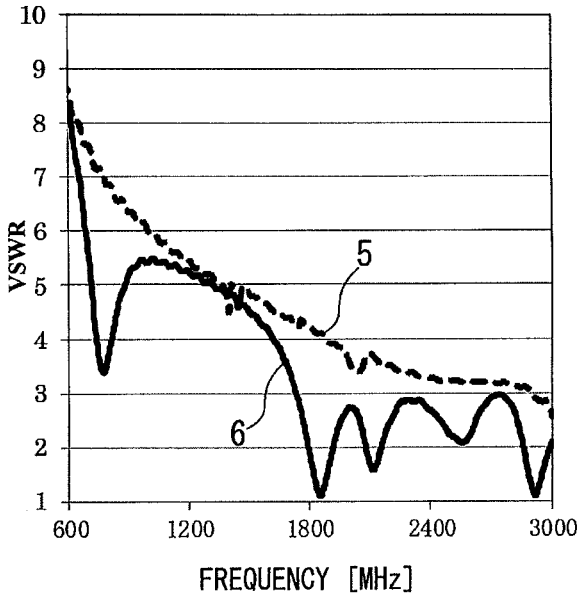
FIG. 13 is a VSWR characteristic graph of the sixth embodiment.
Figure 24:
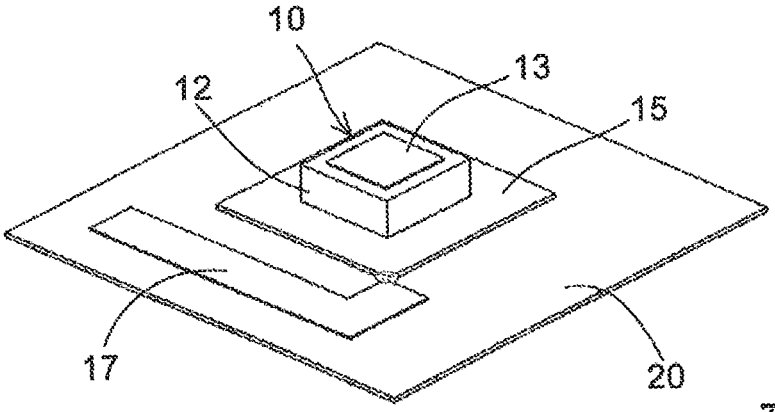
FIG. 24 (Prior Art)
FIG. 24 is a perspective view for illustrating an example including a flat TEL antenna element in parallel on a ground plate in addition to the GNSS patch antenna of FIG. 22, when viewed from above.

FIG. 13 is a VSWR characteristic graph. The vertical axis represents VSWR, and the horizontal axis represents a frequency (MHz). In FIG. 13, a broken line is a VSWR characteristic example of the antenna device of FIG. 24 in which the ground plate 20 is provided as the same as the ground plate 20 of the antenna device 6, and a solid line is a VSWR characteristic example of the antenna device 6 according to this embodiment. As illustrated in FIG. 13, it can be seen that the antenna device 6 of this embodiment (solid line) has lower VSWR over entire frequency bands in the high-band and the low-band of LTE than the antenna device of FIG. 24 (broken line).

Further, the GND conductive pattern 52 having a larger area is formed around the patch antenna 10, thereby impedance of the patch antenna 10 is easily matched to stabilize VSWR characteristics. Further, a distance to the antenna element 42 becomes longer to suppress mutual interference with the antenna element 42.

Seventh Embodiment

Figure 14:
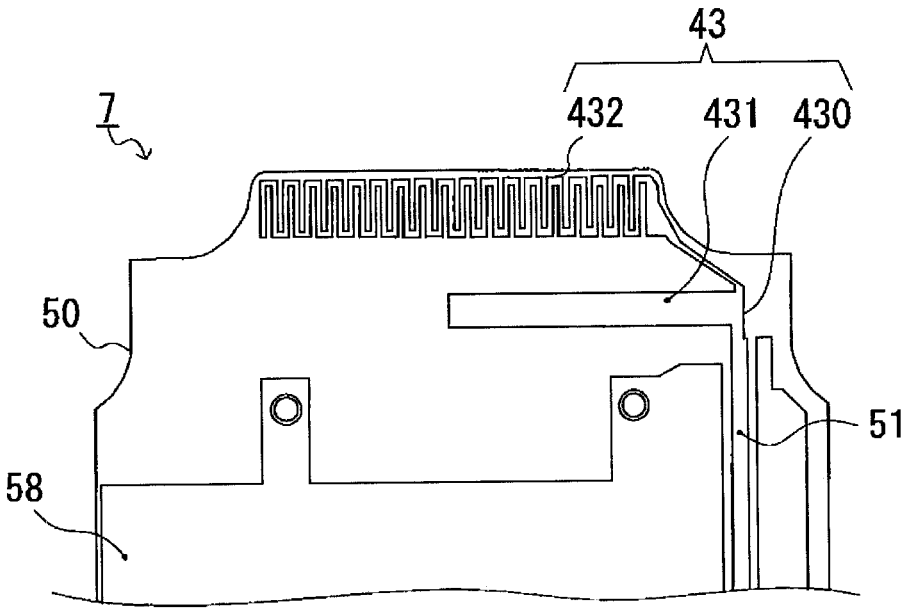
FIG. 14 is a plan view for illustrating the body portion of the antenna device of a seventh embodiment of the present invention, when viewed from below.

A seventh embodiment of the antenna device according to the present invention is explained with reference to FIG. 14 and FIG. 15. FIG. 14 is a plan view for illustrating the body portion of the antenna device of FIG. 11 when viewed from below (direction in which the ground plate 20 is mounted). For convenience, the ground plate 20 is omitted. An antenna device 7 of this embodiment is the same as the sixth embodiment except that the antenna element 43 is formed on the approximate trapezoidal region 54 (non-conductive surface exposed from the notch 22) of the substrate 50 and a shape thereof are different from those illustrated in FIG. 12.

The antenna element 43 includes a high-band portion 431 having a plate-shaped conductive pattern, a distal end of which being an open end, and a low-band portion 432 having a meander-shaped conductive pattern, a distal end of which also being an open end. A feeding end 430 is shared by the respective high-band portion 431 and the low-band portion 432. That is, the conductive pattern (feeding end 430), which is integral with the proximal end (feeding end 430) of the high-band portion 431 and the proximal end of the low-band portion 432, is electrically connected (conductive) to the feeding conductive pattern 51 which is not conductive to the GND conductive pattern 58. The GND conductive pattern 58 is formed near the approximate trapezoidal region 54 and is a different conductive pattern from the GND conductive pattern 52.

The high-band portion 431 resonates at a higher frequency band than the low-band portion 432 to be relatively less susceptible to an influence by the ground plate 20. For that reason, the high-band portion 431 is formed at a position closer to the ground plate 20 than the low-band portion 432.

In the example of FIG. 14, though a length from the proximal end to the distal end of the high-band portion 431 (length in right and left directions in FIG. 14) is shorter than a length from the proximal end to the distal end of the low-band portion 432 (length in the right and left directions in FIG. 14), the antenna element 43 is only required to have a size to resonate in a high-band of LTE. Therefore, the pattern illustrated in FIG. 14 is not always necessary to be used.

Figure 15:
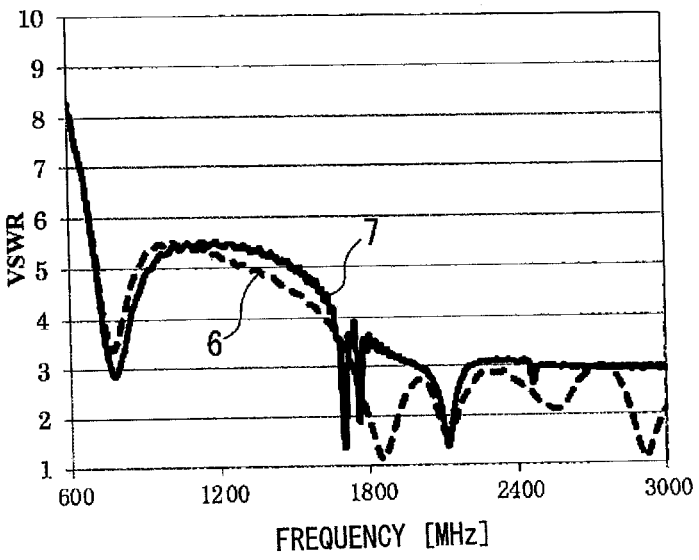
FIG. 15 is a VSWR characteristic graph of the seventh embodiment.

FIG. 15 is a VSWR characteristic graph. The vertical axis represents VSWR, and the horizontal axis represents a frequency (MHz). In FIG. 15, a broken line indicates a VSWR characteristic example of the antenna device 6 of the sixth embodiment, and a solid line indicates a VSWR characteristic example of the antenna device 7 of this embodiment. As illustrated in FIG. 15, it can be seen that the antenna device 7 has lower VSWR in a low-band of LTE than the antenna device 6 of the sixth embodiment, and has less variation in VSWR in a high-band.

Eighth Embodiment

Figure 16:
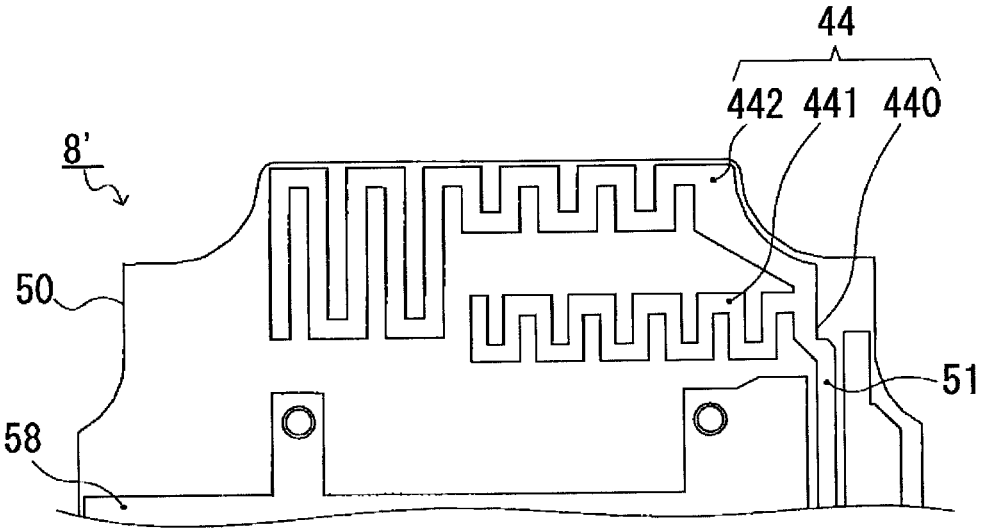
FIG. 16 is a plan view for illustrating the body portion of the antenna device of an eighth embodiment of the present invention, when viewed from below.

An eighth embodiment of the antenna device according to the present invention is explained with reference to FIG. 16 to FIG. 19. FIG. 16 is a plan view for illustrating the body portion of the antenna device of FIG. 11 when viewed from below (direction in which the ground plate 20 is mounted). For convenience, the ground plate 20 is omitted. The antenna device 8 of this embodiment is different from the seventh embodiment in that both a high-band portion 441 and a low-band portion 442 of an antenna element 44 include elements having a meander shape. A feeding end 440 is shared by the respective high-band portion 441 and the low-band portion 442.

The low-band portion 442 has a plate-shaped element at a proximal end having a relatively larger area than a remaining element toward a distal end, and the element extending from the proximal end to the distal end has a meander shape. In this case, a first turn of the meander shape starts at a portion far away from the feeding end 440 and the GND conductive pattern 58. Further, in the element on a way to the distal end, in a section not having the high-band portion 441 near the turns, the turns extend long downward (downward direction of FIG. 16) than a portion parallel to the turns of the high-band portion 441. Therefore, a length from the proximal end to the distal end of the low-band portion 442 (right and left directions in FIG. 16) can be shortened.

Further, the turn portions at the distal end and in the vicinity of the distal end of the low-band portion 442 do not exceed a width of the element of the high-band portion 441 (width in up and down directions of FIG. 16). That is, a distance between each turn portion or the distal end of the element having a meander shape and the GND conductive pattern 58 is always longer than that of the high-band portion 441. Therefore, in a low-band of LTE, narrowing a band can be restrained in a frequency range in which VSWR is reduced to a practical level.

Figure 17:
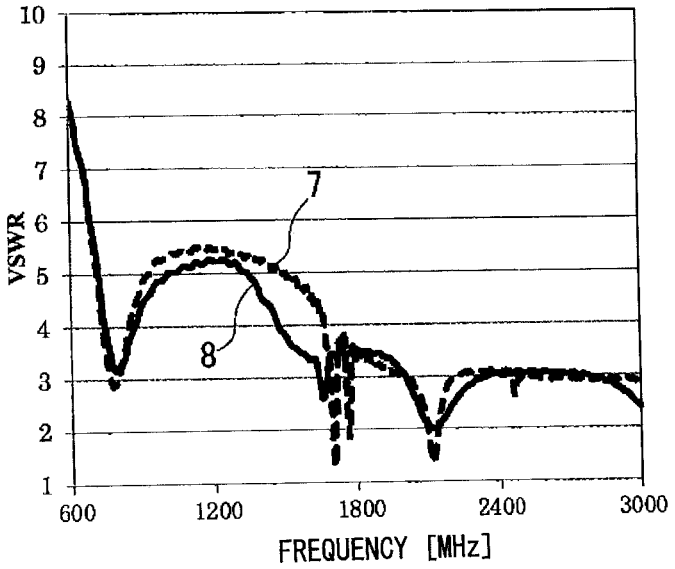
FIG. 17 is a VSWR characteristic graph of the eighth embodiment.

FIG. 17 is a VSWR characteristic graph. The vertical axis represents VSWR and the horizontal axis represents a frequency (MHz). In FIG. 17, a broken line is a VSWR characteristic example of the antenna device 7 of the seventh embodiment, and a solid line is a VSWR characteristic example of the antenna device 8 of this embodiment. As illustrated in FIG. 17, in case of the eighth embodiment, it can be seen that VSWR in the low-band of LTE becomes lower than that of the antenna device 7 as a whole, and a phenomenon in which VSWR rapidly changes in the high-band of LTE can be alleviated.

The meander-shaped conductive patterns having a meander shape of the high-band portion 441 and the low-band portion 442 are not limited to the example described in this embodiment, and can be optionally changed as long as the antenna device resonates in a frequency band of LTE. For example, conductive patterns of an antenna device 8' illustrated in FIG. 18 may be used. In the example shown in FIG. 18, a length from a proximal end to a distal end of a high-band portion 451 is formed to be shorter than that illustrated in FIG. 16, and the distal end is formed to be lower than a height of the proximal end (up and down directions of FIG. 18). Further, the low-band portion 452 has a proximal end having a larger area than that of the example illustrated in FIG. 16. The number of turns having a meander shape is fewer than that of the example illustrated in FIG. 16 by that size. The low-band portion 452 has a first turn of the element extending from the proximal end to the distal end. The first turn starts at a portion closest to a feeding end 450 and the GND conductive pattern 51. The feeding end 450 is shared by the respective high-band portion 451 and the low-band portion 452.

Figure 18:
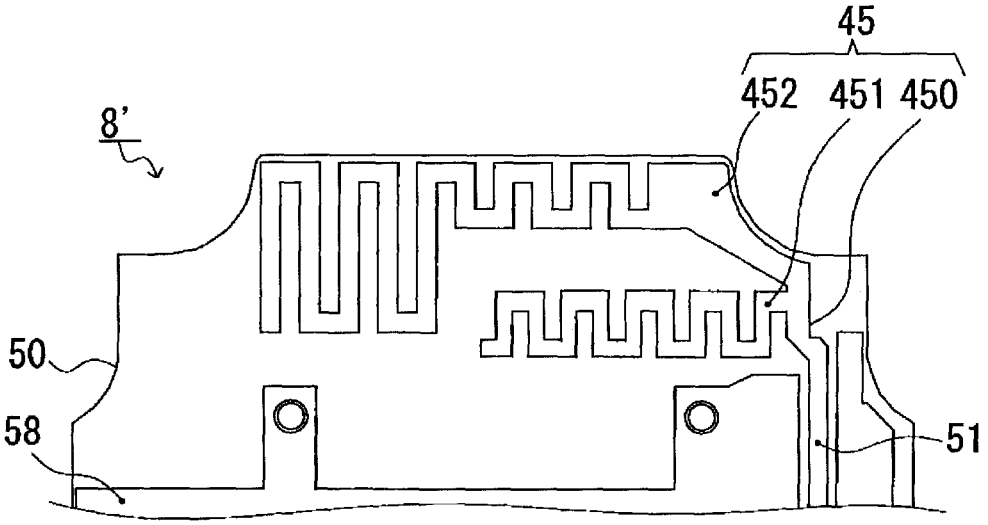
FIG. 18 is a plan view for illustrating the body portion of the antenna device as a modification example of the eighth embodiment, when viewed from below.
Figure 19:
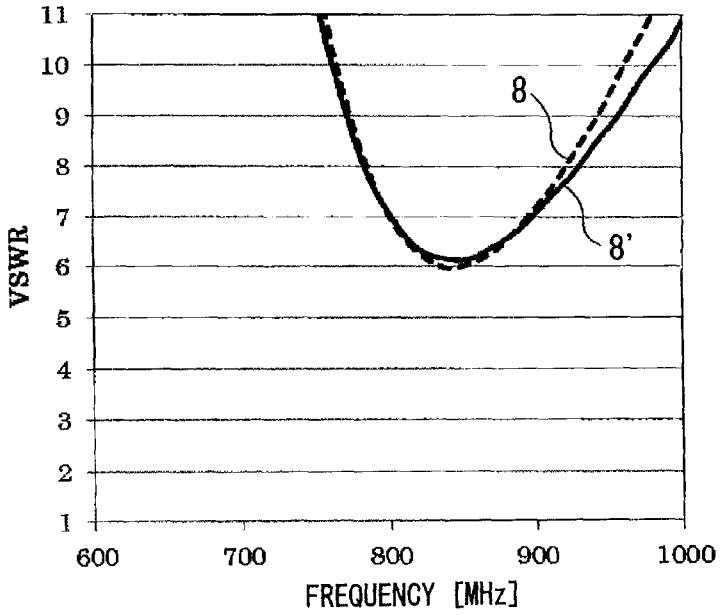
FIG. 19 is a VSWR characteristic graph of the modification example.

FIG. 19 is a VSWR characteristic graph for this case. In FIG. 19, a broken line is a VSWR characteristic example of the antenna device 8 including the antenna element 44 illustrated in FIG. 16, and a solid line is a VSWR characteristic example of the antenna device 8' including an antenna element 45 illustrated in FIG. 18. As illustrated in FIG. 19, it can be seen that, in case of the antenna device 8', VSWR in a frequency band exceeding 900 MHz in the low-band of LTE is lower, and a widening a band can be achieved.

In the examples of FIG. 16 and FIG. 18, the positions of the turns near the distal ends of the low-band portions 442 and 452 do not exceed widths (up and down directions in the drawing) of the high-band portions 441 and 451. However, when the positions exceed the widths of the high-band portions 441 and 451 to be close to the GND conductive pattern 58, it is known that a range, in which VSWR in the low-band of LTE can be satisfactorily maintained, is sharply narrowed.

Ninth Embodiment

Figure 20A:
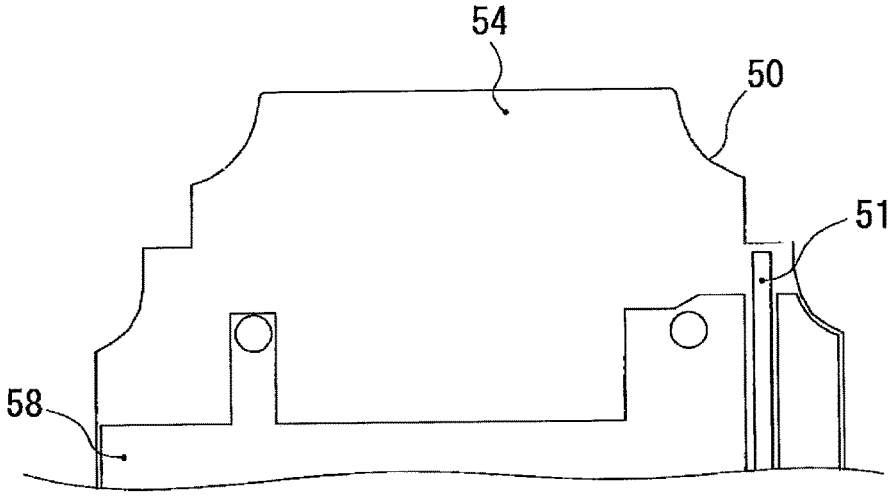
FIG. 20A is a plan view for illustrating the body portion of the antenna device of a ninth embodiment of the present invention, when viewed from below.
Figure 20B:
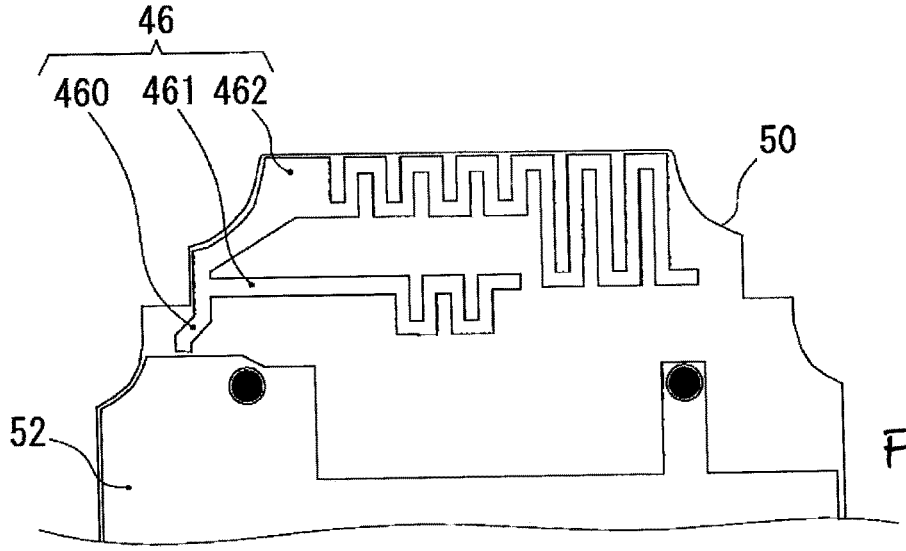
FIG. 20B is a plan view for illustrating the body portion of the antenna device of the ninth embodiment, when viewed from above.

A ninth embodiment of the antenna device according to the present invention is explained with reference to FIG. 20A and FIG. 20B. FIG. 20A is a plan view of the body portion of the antenna device of FIG. 11 when viewed from below (direction in which the ground plate 20 is mounted), and FIG. 20B is a plan view of the body portion of the antenna device of FIG. 11 when viewed from above (rear side of FIG. 20A). An antenna device 9 of this embodiment is different from the eighth embodiment in the shape and the formed position of an antenna element 46.

The antenna device 9 of this embodiment has the antenna element 46 which is formed on a non-conductive surface in a front surface of the approximately trapezoidal region 54 in the substrate 50, and which is electrically connected (conductive) via a through hole to the feeding conductive pattern 51 formed on a rear surface of the region 54. A high-band portion 461 is formed along an outer edge shape of the GND conductive pattern 52 having a constant distance from the outer edge. That is, in a section in which the outer edge of the GND conductive pattern 52 is protruded in a direction of the antenna element 46, an element extending from a proximal end of the high-band portion 461 is straight, and, in a section in which the outer edge of the GND conductive pattern 52 is away from the antenna element 46, the element has a meander shape and a distal end has the same height as the proximal end (up and down directions in FIG. 20B). For that reason, as compared with the high-band portions 431, 441, and 451 as illustrated in FIG. 14, FIG. 16, and FIG. 18, the high-band portion 461 is less susceptible to an influence by the GND conductive patterns 52 and 58, and the ground plate 20, thereby VSWR in the high-band of LTE is lowered. Further, in addition to alleviation of variation in VSWR, there is an effect of improvement in an average gain of a horizontally polarized wave.

Meanwhile, the low-band portion 462 has a plate-shaped portion at the proximal end having a relatively larger area than a remaining element toward the distal end. Further, in the element in middle up to the distal end, in a section not having the high-band portion 461 near portions of the turns having a meander shape, a turn length (length extending downward of FIG. 20B) becomes longer than a section in which the turns are parallel to the turns of the high-band portion 461. Therefore, a length extending from the proximal end of the low-band portion 462 (right and left directions in FIG. 20B) can be shortened. Still further, any turn portion of the low-band portion 462 is not configured to extend toward the GND conductive pattern 52 compared to an element farthest away from the GND conductive pattern 52 in the high-band portion 461. For that reason, the low-band portion 462 is less susceptible to an influence by the GND conductive patterns 52 and 58, and the ground plate 20, thereby VSWR in the low-band of LTE is lowered. Further, in addition to alleviation of variation in VSWR, there is an effect of improvement in the average gain of a horizontally polarized wave.

A feeding end 460 is shared by the respective high-band portion 461 and the low-band portion 462.

The non-conductive surface of the substrate 50 is transmittable by radio waves, so that radio waves can be transmitted or received on the front surface (surface on which the patch antenna 10 is provided) of the substrate 50 on which the antenna element 46 is formed. Then, an average gain in the low-band and the high-band of the LTE is increased.

Figure 21A:
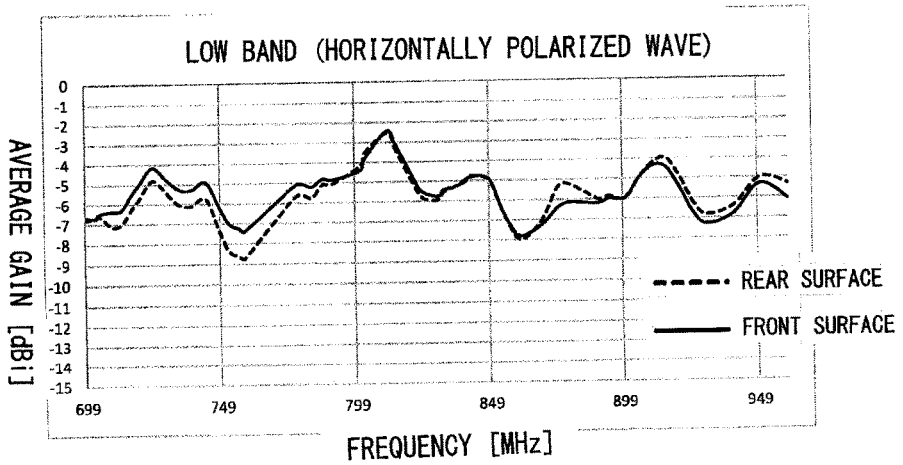
FIG. 21A is a graph showing average gain characteristics in a low-band of the ninth embodiment.
Figure 21B:
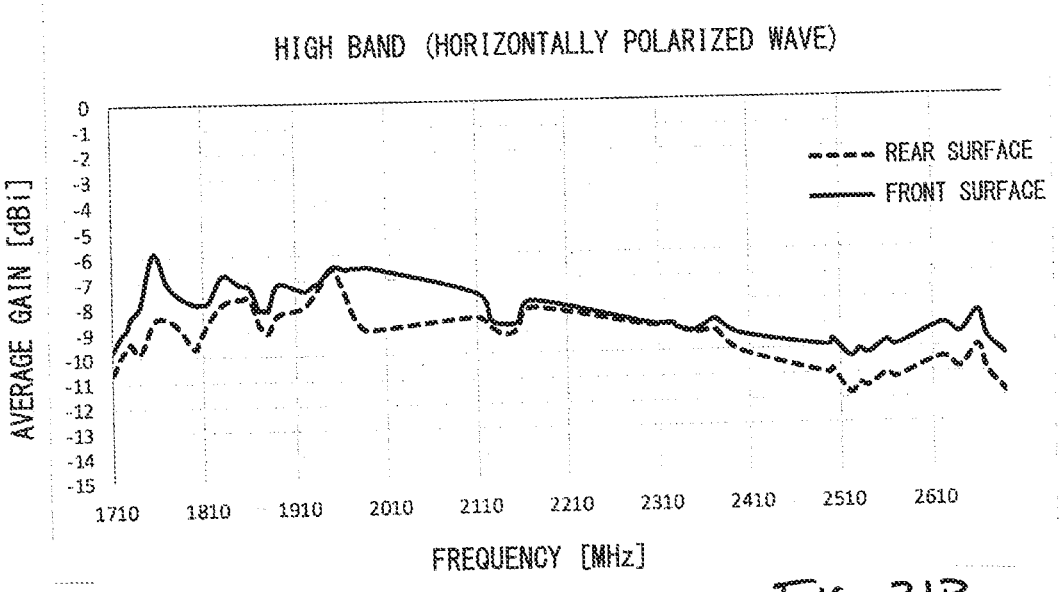
FIG. 21B is a graph showing average gain characteristics in a high-band of the ninth embodiment.

FIG. 21A and FIG. 21B are graphs showing average gain characteristics when the ground plate 20, the antenna element 46, the substrate 50, and the GND conductive patterns 52 and 58 of the antenna device 9 of the embodiment are arranged parallel to the ground, and an operation is simulated. In this case, a radio wave to be transmitted or received by the antenna element 46 is a horizontally polarized wave. FIG. 21A is the graph showing the average gain characteristic example of the horizontally polarized wave in the horizontal plane in the low-band of LTE, and FIG. 21B is the graph showing the average gain characteristic example of the horizontally polarized wave in the horizontal plane in the high-band of LTE. In these drawings, the vertical axis represents average gain of the horizontally polarized wave (dBi), and the horizontal axis represents a frequency (MHz). Further, a broken line represents an average gain characteristic example when the antenna element 46 is formed on the rear surface of the substrate 50, that is, in the region 54 illustrated in FIG. 20A, and a solid line represents an average gain characteristic example in the antenna device 9 according to this embodiment.

As in this embodiment, it can be seen that, when the antenna element 46 is formed on the front surface of the substrate 50, the average gain becomes higher in most frequency bands.

Further, the average gain around 810 MHz in the low-band and around 1760 MHz in the high-band are higher than other frequency bands on both the front surface and the rear surface.

REFERENCE SIGNS LIST

1, 2, 3, 4, 5, 6, 7, 8, 8', 9 antenna device
10 patch antenna
12 dielectric body
15 LNA substrate
16, 17, 30, 40, 42, 43, 45, 46 antenna element
20 ground plate
21, 23 side edge portion
22, 24 notch
50 substrate
55 connector
60 holder

The invention claimed is:

1. An antenna device to be mounted on a vehicle, comprising:

a ground conductor having a planar shape and including a cut-out portion;

an antenna element which is a resonant type, is provided at the cut-out portion so as not to overlap with the ground conductor within a plane substantially parallel to the ground conductor, and is configured to transmit or receive polarized waves in multiple frequency bands which are parallel to the ground conductor; and a substrate fixed on a surface of the ground conductor, where a part of a surface of the substrate is a non-conductive surface exposed from the cut-out portion, and a rear surface of the part of the surface of the substrate is non-conductive surfaces exposed from the cut-out portion, wherein the antenna element is a conductive pattern formed on the non-conductive surface, wherein another part of the surface of the substrate is a conductive surface which is conductive to the ground conductor, wherein the substrate has a feeding conductive pattern which is not conductive to the conductive surface, and wherein a feeding end of the antenna element is conductive to the feeding conductive pattern.

2. The antenna device according to claim 1, wherein the antenna element has a plurality of end portions, and wherein one of the plurality of the end portions is conductive to the conductive surface, and another one of the plurality of the end portions is the feeding end.

3. The antenna device according to claim 1, wherein the antenna element has a plurality of end portions, and wherein one of the plurality of the end portions is conductive to the feeding conductive pattern, and another one of the plurality of the end portion is an open end.

4. The antenna device according to claim 1, wherein the antenna element has at least a portion having a meander shape.

5. The antenna device according to claim 4, wherein the antenna element includes a high-band portion for LTE (long term evolution) high-band operation and a low-band portion for LTE (long term evolution) low-band operation, wherein the high band portion has a plate shape, and wherein the low-band portion has a meander shape which extends from the high-band portion.

6. The antenna device according to claim 4, wherein the antenna element includes a high-band portion for LTE (long term evolution) high-band operation and a low-band portion for LTE (long term evolution) low-band operation, wherein the high band portion has a plate shape, wherein the low-band portion has at least a portion having a meander shape, and wherein the high-band portion and the low-band portion are configured to share a feeding end.

7. The antenna device according to claim 6, wherein distal end portions of the low-band portion and the high-band portion are arranged substantially parallel to each other from the feeding end, and the high-band portion is formed closer to a surface portion, which is conductive to the ground conductor, than the low-band portion.

8. The antenna device according to claim 7, wherein an element having a meander shape of the low-band portion is configured to start turning from a closest portion with respect to the high-band portion.

9. The antenna device according to claim 4, wherein the antenna element includes a high-band portion for LTE (long term evolution) high-band operation and a low-band portion for LTE (long term evolution) low-band operation, wherein each of the high-band portion and the low-band portion has at least a portion having a meander shape, and is configured to share a feeding end.

10. The antenna device according to claim 1, wherein a patch antenna is provided at any portion of the conductive surface via a dielectric body.

11. The antenna device according to claim 1, further comprising:

a holder, which is configured to accommodate a body portion of the antenna device including a substrate and the ground conductor, and is removably mountable from/to an antenna attachment mechanism provided in the vehicle, wherein the holder includes a bottom surface portion which faces the ground conductor, and wherein a lateral width and a length in a longitudinal direction of the ground conductor are approximately equal to a lateral width and a length in the longitudinal direction of the bottom surface portion of the holder.

12. The antenna device according to claim 1, wherein the antenna element includes a high-band portion for LTE (long term evolution) high-band operation and a low-band portion for LTE (long term evolution) low-band operation, wherein the high band portion has a plate shape, and wherein the low-band portion has a meander shape which extends from the high-band portion.

13. The antenna device according to claim 1, wherein the antenna element includes a high-band portion for LTE (long term evolution) high-band operation and a low-band portion for LTE (long term evolution) low-band operation, wherein the high band portion has a plate shape, wherein the low-band portion has at least a portion having a meander shape, and wherein the high-band portion and the low-band portion are configured to share a feeding end.

14. The antenna device according to claim 1, wherein the antenna element includes a high-band portion for LTE (long term evolution) high-band operation and a low-band portion for LTE (long term evolution) low-band operation, wherein each of the high-band portion and the low-band portion has at least a portion having a meander shape, and is configured to share a feeding end.

* * * * *